US010819023B2

(12) United States Patent
Choon et al.

(10) Patent No.: US 10,819,023 B2
(45) Date of Patent: Oct. 27, 2020

(54) ANTENNA SYSTEM AND COMMUNICATION TERMINAL

(71) Applicant: AAC Technologies Pte. Ltd., Singapore (SG)

(72) Inventors: Tan Yew Choon, Singapore (SG); Ng Guan Hong, Singapore (SG); Tay Yew Siow, Singapore (SG)

(73) Assignee: AAC Technologies Pte. Ltd., Singapore (SG)

( * ) Notice: Subject to any disclaimer, the term of this patent is extended or adjusted under 35 U.S.C. 154(b) by 34 days.

(21) Appl. No.: 16/296,486

(22) Filed: Mar. 8, 2019

(65) Prior Publication Data

US 2020/0194878 A1 Jun. 18, 2020

(30) Foreign Application Priority Data

Dec. 18, 2018 (CN) ..... 2018 1 1547680

(51) Int. Cl.

| | |
|---|---|
| ***H01Q 21/00*** | (2006.01) |
| ***H01Q 5/35*** | (2015.01) |
| ***H01Q 1/36*** | (2006.01) |
| ***H01Q 1/50*** | (2006.01) |
| ***H01Q 21/06*** | (2006.01) |
| ***H04R 1/40*** | (2006.01) |

(52) U.S. Cl.

CPC ..... *H01Q 1/36* (2013.01); *H01Q 1/50* (2013.01); *H01Q 21/061* (2013.01); *H04R 1/403* (2013.01)

(58) Field of Classification Search

CPC .. H01Q 1/36; H01Q 1/22; H01Q 1/50; H01Q 5/35; H01Q 21/0025; H01Q 21/293; H01Q 23/00; H01Q 21/061; H01Q 21/00; H04M 1/026; H04M 1/03; H04R 1/403; H04R 1/4033

See application file for complete search history.

(56) References Cited

U.S. PATENT DOCUMENTS

| | | | | |
|---|---|---|---|---|
| 10,263,318 | B2 * | 4/2019 | Yan | H01Q 1/243 |
| 2016/0301143 | A1 * | 10/2016 | Cao | H01P 5/12 |
| 2019/0165478 | A1 * | 5/2019 | Jo | H01Q 1/243 |
| 2019/0245262 | A1 * | 8/2019 | Xia | H04M 1/026 |

FOREIGN PATENT DOCUMENTS

| | | | |
|---|---|---|---|
| CN | 108682940 | A1 | 10/2018 |
| JP | 2012129943 | A1 | 7/2012 |

OTHER PUBLICATIONS

PCT search report dated Jan. 6, 2020 by SIPO in related PCT Patent Application No. PCT/CN2019/109029 (4 Pages).

* cited by examiner

*Primary Examiner* — Thai Pham

(74) *Attorney, Agent, or Firm* — IPro, PLLC; Na Xu

(57) ABSTRACT

The invention provides an antenna system including subarray loudspeaker units. The subarray loudspeaker units includes: a metal base; a circuit board overlapped on and electrically connected to the metal base and including a circuit board body for forming a system ground and four parallel rectangular slots penetrating the circuit board body for forming a central area; a phase shift unit including a phase shift chip overlapped on and electrically connected to the circuit board and located at the central area; and loudspeaker units. The loudspeaker units includes four loudspeakers electrically connected to the circuit board and connected with each other for surrounding the phase shift unit, each of the loudspeaker units inserting into a corresponding slot.

8 Claims, 11 Drawing Sheets

ANTENNA SYSTEM AND COMMUNICATION TERMINAL

FIELD OF THE PRESENT DISCLOSURE

The invention involves one kind of antenna, especially one kind of antenna system and communication terminal applied in the field of communication electronic product.

DESCRIPTION OF RELATED ART

With the development of mobile communication technology, cell phones, PAD and laptops etc, gradually become indispensable electronic products in life. Moreover, this type of electronic product is updated to add antenna system to make it become an electronic communication product with communication function.

5G is the focus of research and development in the industry all over the world. Its three main application highlights are: enhanced mobile broadband, large-scale machine communication, high reliability and low delay communication. Three application highlights correspond respectively to different key indicators, wherein the user peak speed in the enhanced mobile bandwidth is 20 Gbps and the minimum user experience speed is 100 Mbps. The unique characteristics of millimeter wave, i.e. high carrier frequency and large bandwidth are the main aspects to realize 5G ultra-high data transmission speed. Therefore, the rich bandwidth resources in millimeter wave band provide guarantee for high-speed transmission.

However, due to the intense space loss of electromagnetic waves in this frequency band of millimeter wave, wireless communication antenna system using millimeter wave band needs phased array architecture. The phase of each array element is distributed according to a certain rule through a phase shifter, so as to form a high gain wave beam, and the beam is scanned in a certain spatial range by changing the phase shift. But if line-of-sight communication cannot be maintained between the transmitter and receiver of the antenna system in millimeter wave band, the communication link is easily broken. If the bandwidth of the frequency band covered in the beam range is limited, the reliability of the antenna system will be affected.

However, it is necessary to provide one kind new antenna system and communication terminal to solve the above-mentioned problem.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

FIG. 7*a* and FIG. 7*b* are the S-parameter feature curve graph of the subarray loudspeaker unit of FIG. 1, wherein, FIG. 7*a* is the reflection coefficient curve graph of all loudspeakers in the subarray loudspeaker unit. FIG. 7*b* is the curve graph of the isolation degree of one loudspeaker and other three loudspeakers in the subarray loudspeaker unit.

FIG. 11*a* and FIG. 11*b* the S-parameter feature curve graph of FIG. 9, wherein, FIG. 11*a* is the reflection coefficient curve graph of all loudspeakers in the antenna system. FIG. 11*b* is the curve graph of the isolation degree of one loudspeaker and other fifteen loudspeakers in the antenna system.

FIG. 12*a* and FIG. 12*b* show the gain curve graphs in the planes of Phi=0° and Phi=90° when the antenna system of FIG. 9 is at 28 GHz and all loudspeakers have phase differences, wherein, FIG. 12*a* is the gain curve graph in the plane of Phi=0°, and FIG. 12*b* is the gain curve graph in the plane of Phi=90°.

FIG. 15*a* and FIG. 15*b* show the gain curve graphs in the planes of Phi=0° and Phi=90° when the antenna system of FIG. 13 is at 28 GHz and all loudspeakers have phase differences, wherein, FIG. 15*a* is the gain curve graph in the plane of Phi=0°, and FIG. 15*b* is the gain curve graph in the plane of Phi=90°.

DETAILED DESCRIPTION OF THE EXEMPLARY EMBODIMENTS

Figure 1:
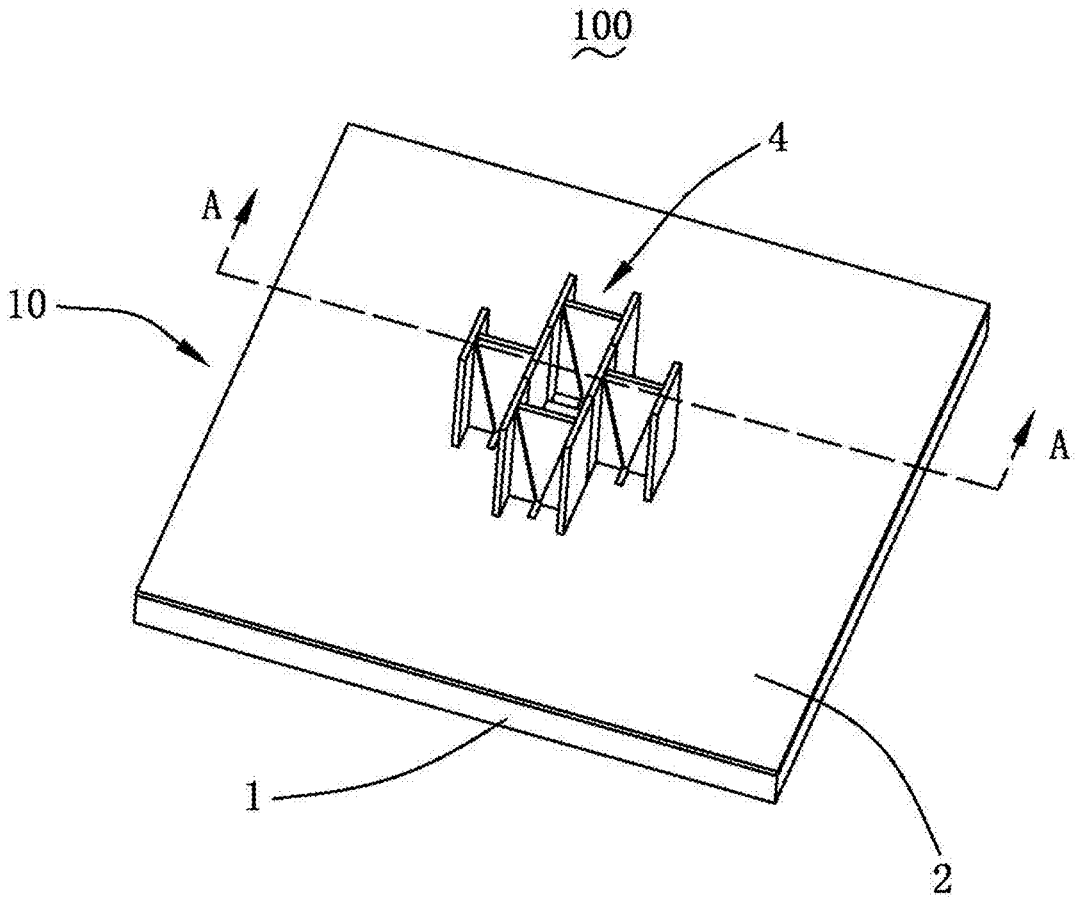
FIG. 1 shows the structure of a subarray loudspeaker unit of an antenna system of the invention.
Figure 2:
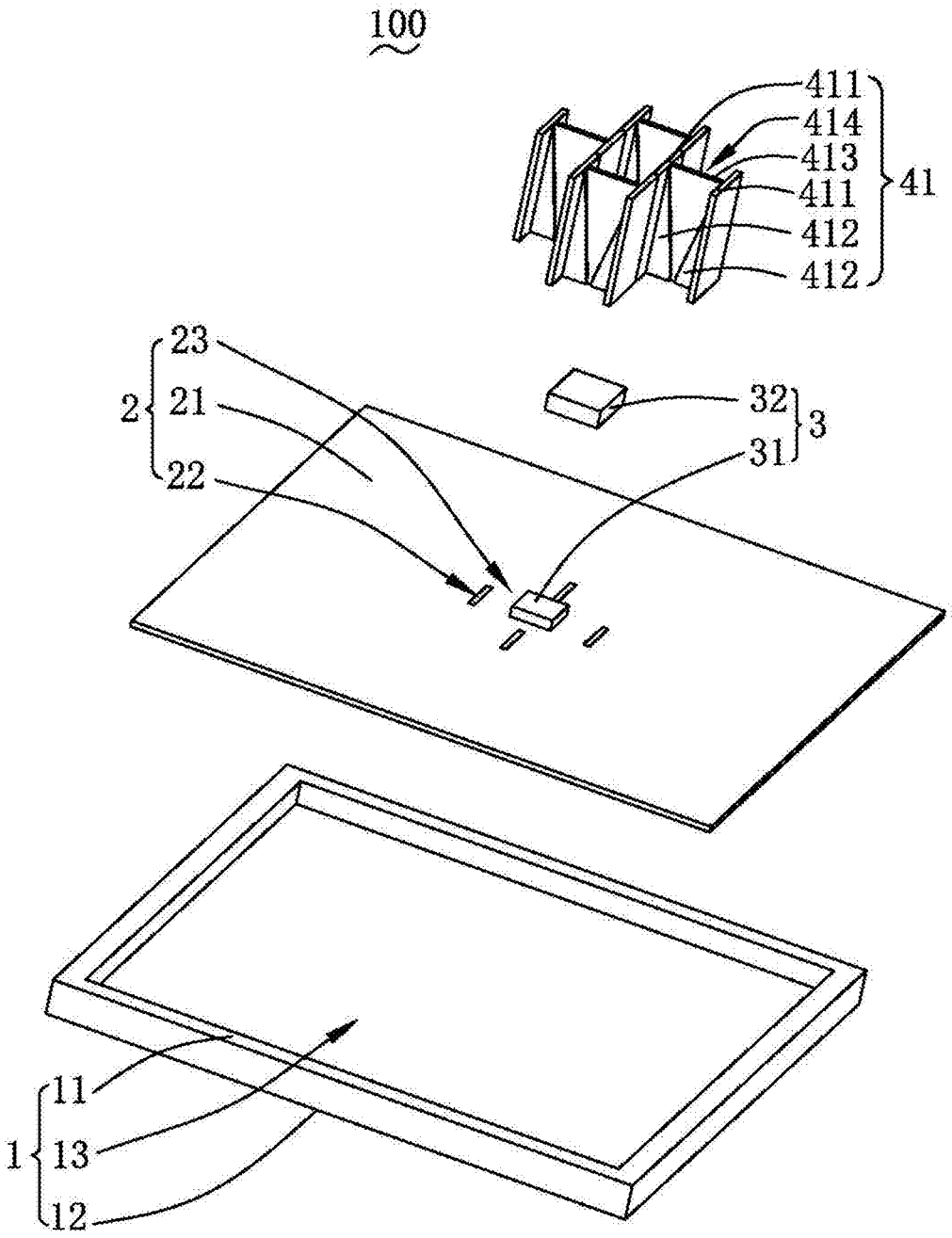
FIG. 2 shows the decomposition of partial three-dimensional structure of the subarray loudspeaker unit of the antenna system of the invention.
Figure 3:
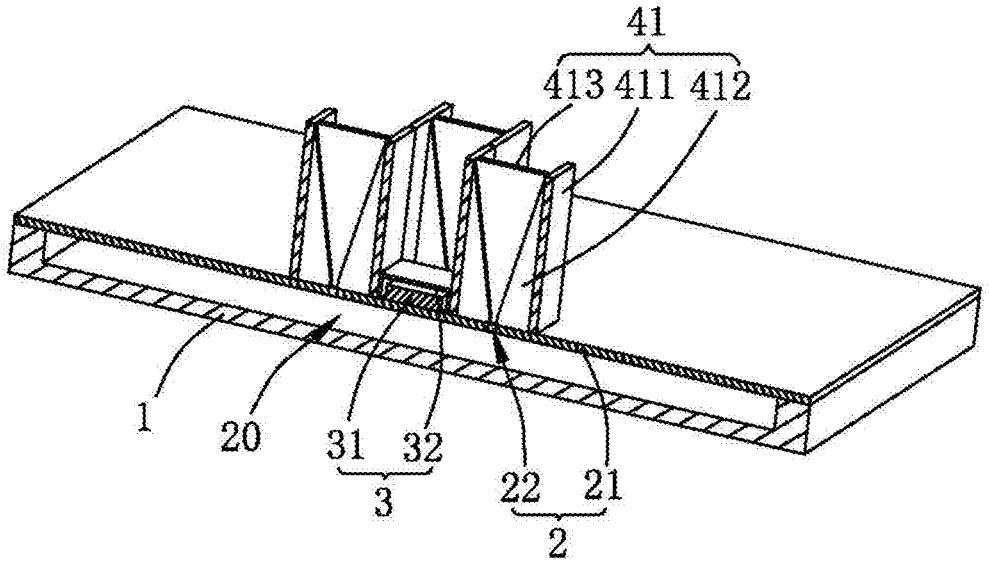
FIG. 3 is the sectional view along A-A line in FIG. 1.
Figure 4:
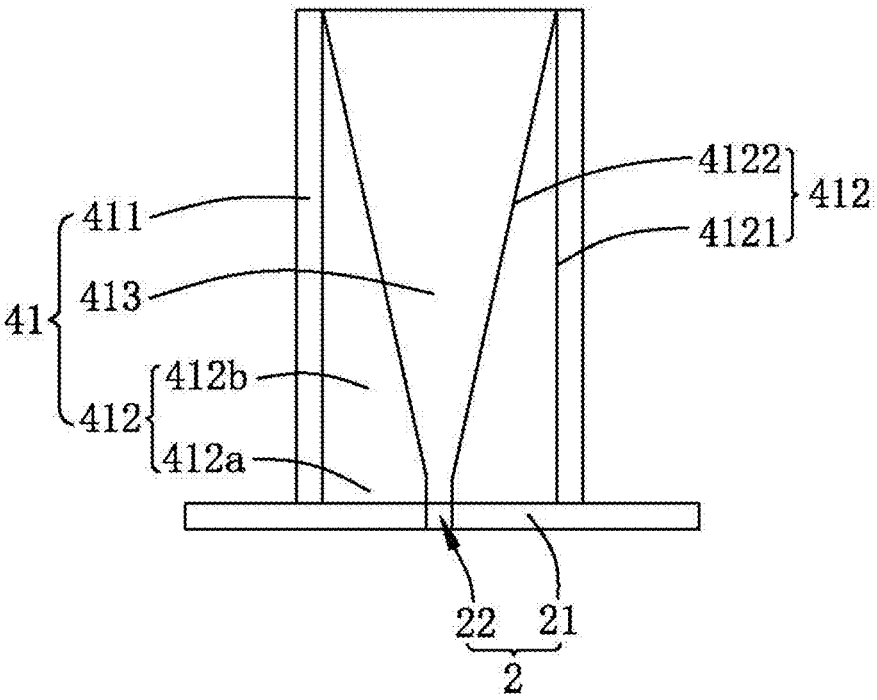
FIG. 4 shows the structure of loudspeakers of the antenna system of the invention.
Figure 5:
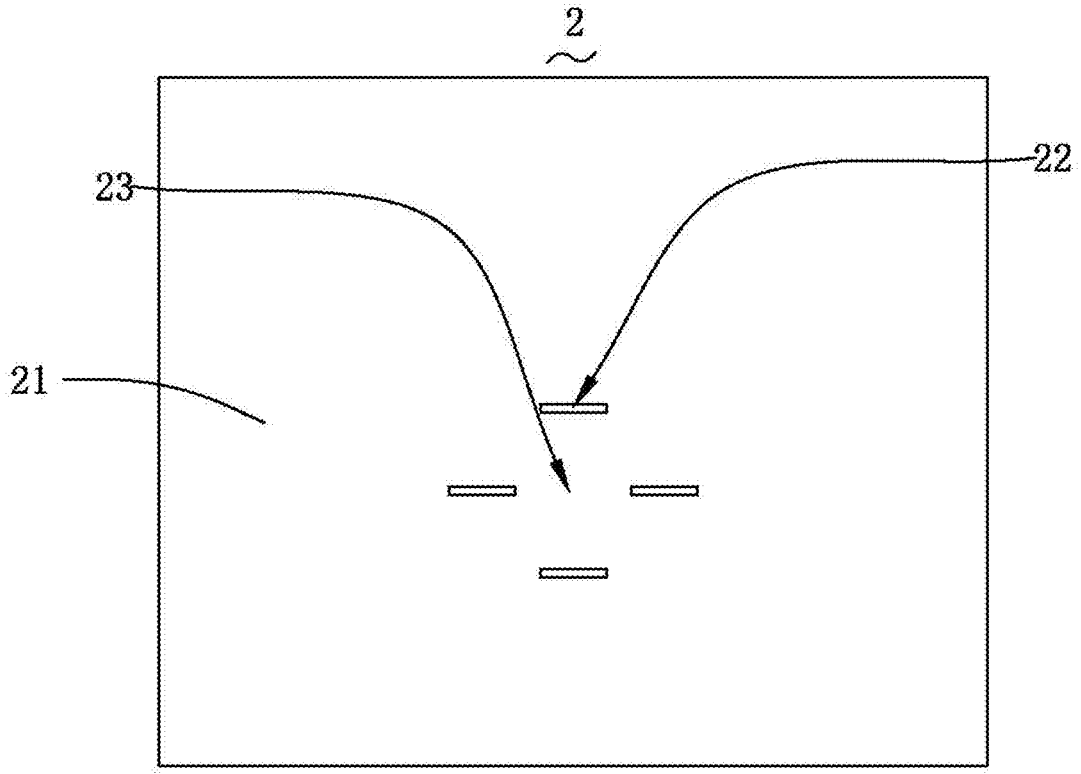
FIG. 5 is the top view of a circuit board in the subarray loudspeaker unit of the antenna system of the invention.

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Please refer to FIGS. 1-6, the invention provides an antenna system 100 which comprises subarray loudspeaker units 10, wherein the subarray loudspeaker units 10 comprise a metal bases 1, circuit boards 2 which are overlapped on and electrically connected with the metal bases 1, phase shift units 3 which are overlapped on and electrically connected with the circuit boards 2, and a loudspeaker unit 4 which is overlapped on and electrically connected with the circuit boards 2.

The metal base 1 shows square three-dimensional structure, such as cuboid structure. The metal base 1 includes a top surface 11, a bottom surface opposite to the top surface 11 and a carinal cavity 13 depressing from the top surface 11 to the bottom surface 12.

The PCB 2 superimposed and set on the top surface 11 of the metal base 1 covers the carinal cavity 13 completely. The circuit boards 2 and the metal bases 1 are electrically connected and together enclose to form a back cavity space 20 which is used for reducing the back-side radiation of the subarray loudspeaker units 10.

The section of each circuit board 2 is square or rectangular. Square is preferred. Each circuit board 2 comprises a circuit board body 21 and four rectangular slots 22 which penetrate the circuit board body 21. In the embodiment, the four slots 22 are arranged in parallel. The four slots 22 stagger to distribute and enclose to form a central area 23.

The circuit board body 21 forms a system. The slots 22 form the feed ports of the subarray loudspeaker units 10. Both ends of each feed port are respectively and electrically connected with both sides of each slot 22 along the width direction. At this time, the feed signals of the subarray loudspeaker units 10 are fed from the feed port.

In the embodiment, the outer contour of the orthographic projection of the metal bases 1 on the circuit boards 2 coincides with the outer contour of the circuit boards 2, and all of them are square.

Each phase shift unit 3 comprises a phase shift chip 31 which is overlapped on and electrically connected with the circuit board 2 and located at the central area 23. In the embodiment, the phase shift chip 31 is a four-core phase shift chip. The phase-shifting chip 31 provides phase difference for all horn elements 4 and lead reflection mode of antenna system 100 within the needed covering angle to ensure that horizon communication between transmitter and receiver not to be interrupted to add overall gain. Specifically, the phase shift chips 31 distribute the phases of all loudspeakers of the loudspeaker units 4 according to a rule so as to form a high gain beam, change the phase shift to scan the beam in a space range, and guide the radiation mode of the antenna system 100 in the required coverage angle in order to keep the uninterrupted horizon communication between a receiver and a transmitter which use the antenna system 100, thus, the reliability is improved.

Preferably, the phase-shifting unit 3 also includes metal shielding part 32 covered completely on the phase-shifting chip 31. The metal shielding parts 32 can reduce and even eliminate the interference of the phase shift chips 31 to the loudspeaker units 4 so as to improve communication reliability.

Each loudspeaker unit 4 comprises four loudspeakers 41 which stagger to distribute. The four loudspeakers 41 are connected end to end in order and annularly arranged on the phase shift unit 3. One loudspeaker 41 is pressed in one slot 22. In the embodiment, the loudspeakers 41 are millimeter-wave antenna loudspeakers.

Specifically, each loudspeaker 41 comprises two side walls 411, two ridges 412 and a dielectric substrate 413, wherein the two side walls 411 are oppositely arranged, the two ridges 412 are respectively and vertically fixed on the inner sides of the two side walls 411, and the dielectric substrate 413 is filled between the two ridges 412.

The two side walls 411 are vertically overlapped on and electrically connected with one circuit board body 21 and respectively located on the two opposite sides in the width direction of the slots 22. More preferably, two side walls 411 of the same loudspeaker 41 are parallel to the slot 22 in which the loudspeaker 41 is pressed and symmetric about the slot 22. Each loudspeaker 41 forms an opening 414 at the end parts of the two side walls 411.

In the embodiment, the four loudspeakers 41 stagger and surround the central area 23. The four loudspeakers 41 are divided into a first set and a second set. The two side walls 411 of the two loudspeakers 41 in the first set are oppositely arranged. The two openings 414 of the two loudspeakers 41 of the second set are oppositely arranged. The two opposite side walls 411 of the two loudspeakers 41 in the first set are respectively included between the two opposite side walls 411 of the two loudspeakers 41 of the second set and connect so as to surround and enclose the central area 23.

The two ridges 412 are vertically overlapped on and electrically connected with one circuit board body 21 and respectively located at the two opposite sides in the width direction of the slot 22. More preferably, the two ridges 412 are respectively and electrically connected with the middle positions of the inner sides of the two side walls 411.

The dielectric substrate 413 is opposite to and in vertical abutment with the slots 22. The width of the dielectric substrate 413, which is in abutment with the slots 22, is equal to the width of the slots 22. The dielectric substrate 413 is a substrate made from insulation materials.

In the structure of the loudspeaker unit 4, the two ridges 412 feed an electric signal via the slot 22 which is used as the feed port structure.

More preferably, each ridge 412 of the loudspeaker 41 comprises an outer wall surface 4121 and an inner wall surface 4122. The outer wall surface 4121 is connected with the side walls 411 and vertical to the circuit board 2. The inner wall surface 4122 gradually opens from the end close to the circuit board 2 towards the end which is far away from the circuit board 2, thus, the cross section area of the end of the ridge 412, which is close to the circuit board 2, is larger than the cross section area of the end of the ridge, which is far away from the circuit board 2. The loudspeakers 41 in the structure above form a loudspeaker-shaped structure.

Specifically, the ridge 412 comprises a fixed part 412*a* and an extension part 412*b*, wherein, the fixed part 412*a* connects with the circuit board body 21, and the extension part 412*b* extends from the fixed part 412*a* to the end of the side wall 411, which is far away from the circuit board body 21. The extension part 412*b* gradually opens from the end which is close to the fixed part 412*a* towards the end which is far away from the fixed part 412*a*, thus, the cross section area of the end of the extension part 412*b*, which is close to the fixed part 412*a*, is larger than the cross section area of the end, which is far away from the fixed part 412*a*.

The subarray loudspeaker units 10 above form a millimeter wave phase control array antenna system structure in which four units stagger and combine.

Figure 7A:
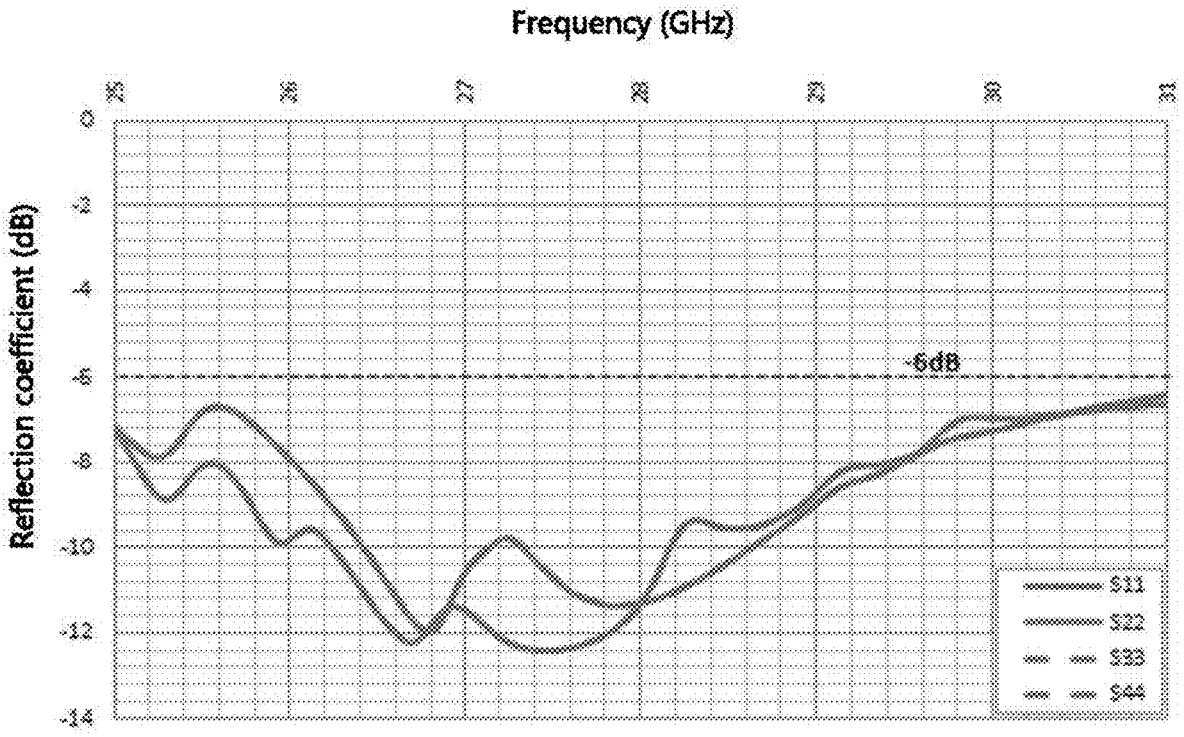
Figure 7B:
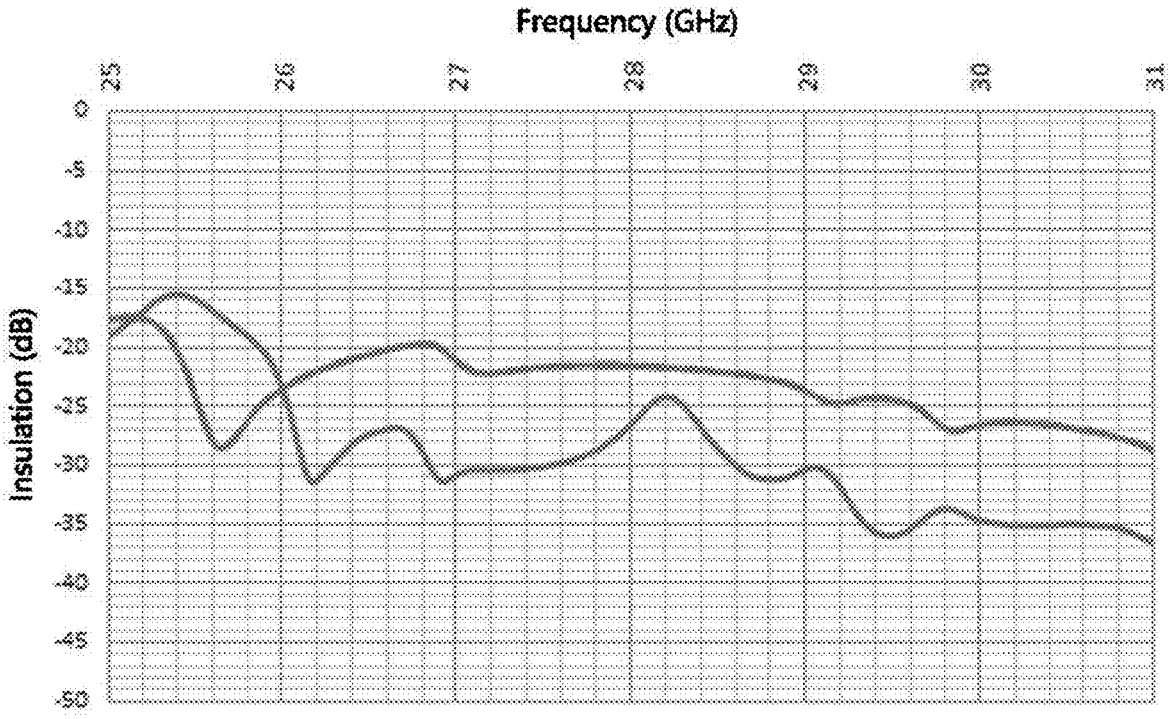
Figure 8:
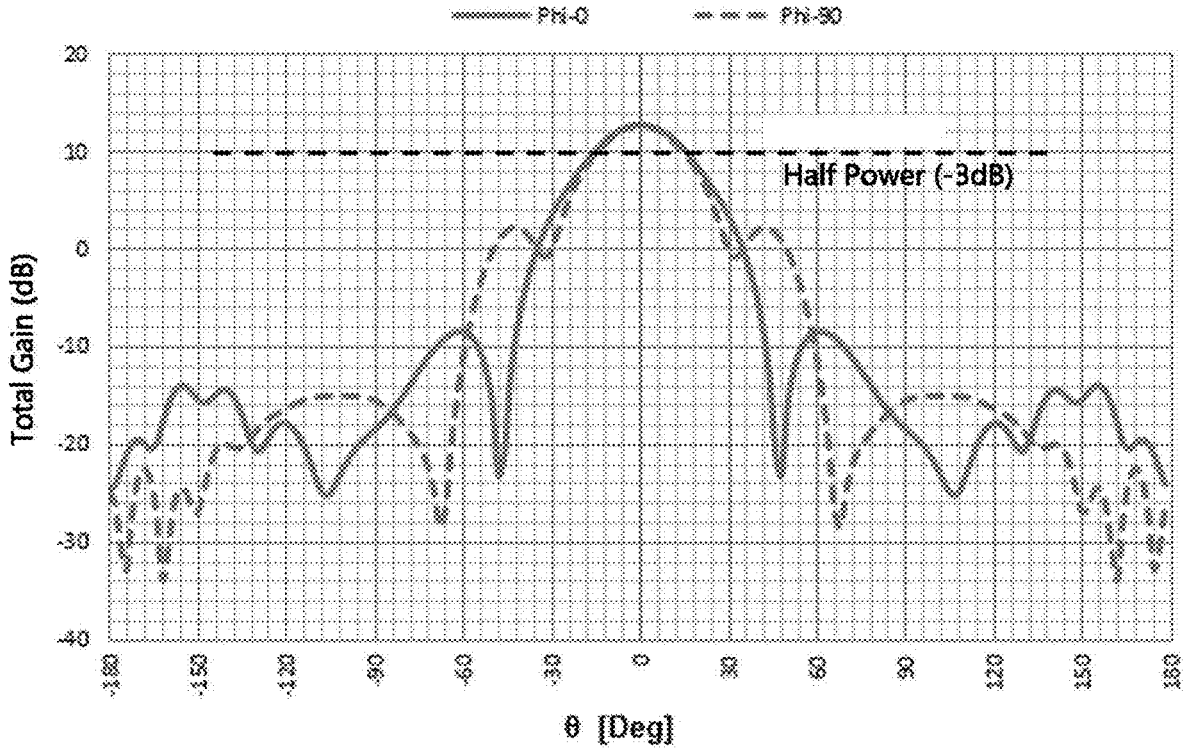
FIG. 8 shows the gain curve graphs in the planes of Phi=0° and Phi=90° when the subarray loudspeaker unit of the invention is at 28 GHz and all loudspeakers are in equal-amplitude in-phase feed.

Please refer to FIG. 7*a*, FIG. 7*b* and FIG. 8. FIG. 7*a* and FIG. 7*b* are the S-parameter feature curve graph of the subarray loudspeaker unit of FIG. 1.

Wherein, FIG. 7*a* is the reflection coefficient curve graph of each loudspeaker in the subarray loudspeaker units. The reflection coefficient curves of the four loudspeakers are respectively S11, S22, S33 and S44. The reflection coefficients of all of the four loudspeakers are lower than −6 dB in 25 GHz-30 GHz and all of the bandwidths are higher than 5 GHz.

FIG. 7*b* is the curve graph of the isolation degree of one loudspeaker and the other three loudspeakers in one subarray loudspeaker unit. In the frequency range from 25 GHz-31 GHz, the isolation degree is kept to be lower than −15 dB. The isolation degree is lower than −20 dB at 28 GHz.

Figure 6:
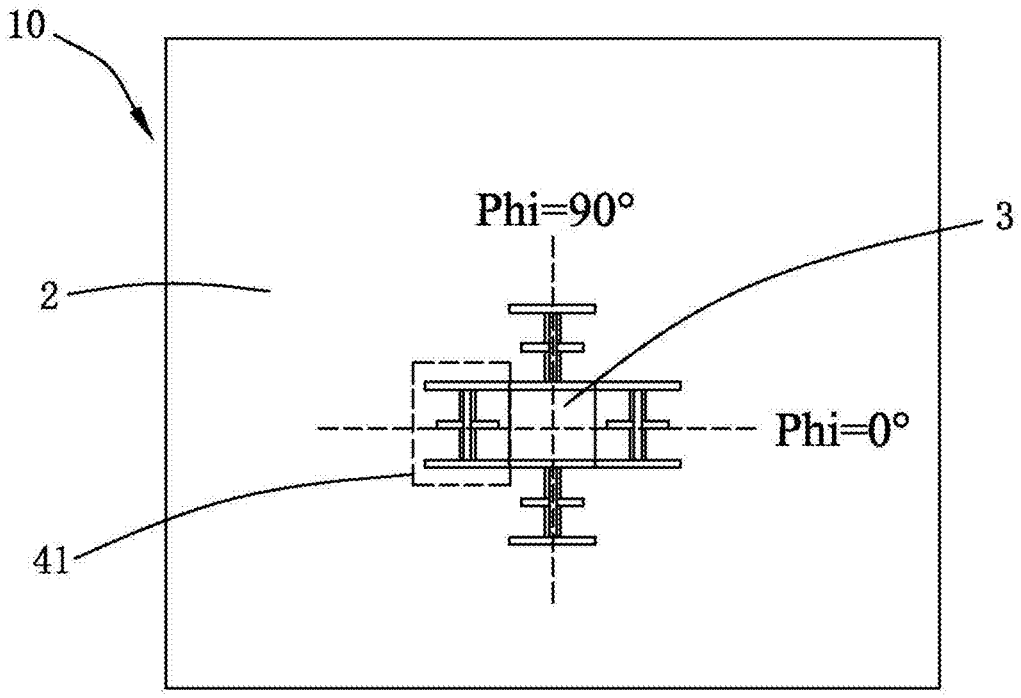
FIG. 6 is the top view of FIG. 1.

FIG. 8 shows the gain curve graphs when each subarray loudspeaker unit of the invention is at 28 GHz and all loudspeakers are in equal-amplitude in-phase feed, and includes the gain curve graphs in the planes of Phi=0° and Phi=90°, wherein, the planes of Phi=0° and Phi=90° are respectively the ones shown in FIG. 6. At 28 GHz, the maximum gain of the millimeter wave phase control array antenna system of the arrangement of the four loudspeakers on the planes of Phi=0° and Phi=90° is 12.9 dBi, and the half power beam width (HPBW) is 28° (from θ=−14° to θ=14°).

The antenna system of the invention can comprise N subarray loudspeaker units 10 which stagger to distribute and are mutually and electrically connected to form the phase control array antenna system structure. The metal bases 1 of the N subarray loudspeaker units 10 are in an integrated structure. The circuit boards 2 of the N subarray loudspeaker units 10 is in an integrated structure.

Figure 9:
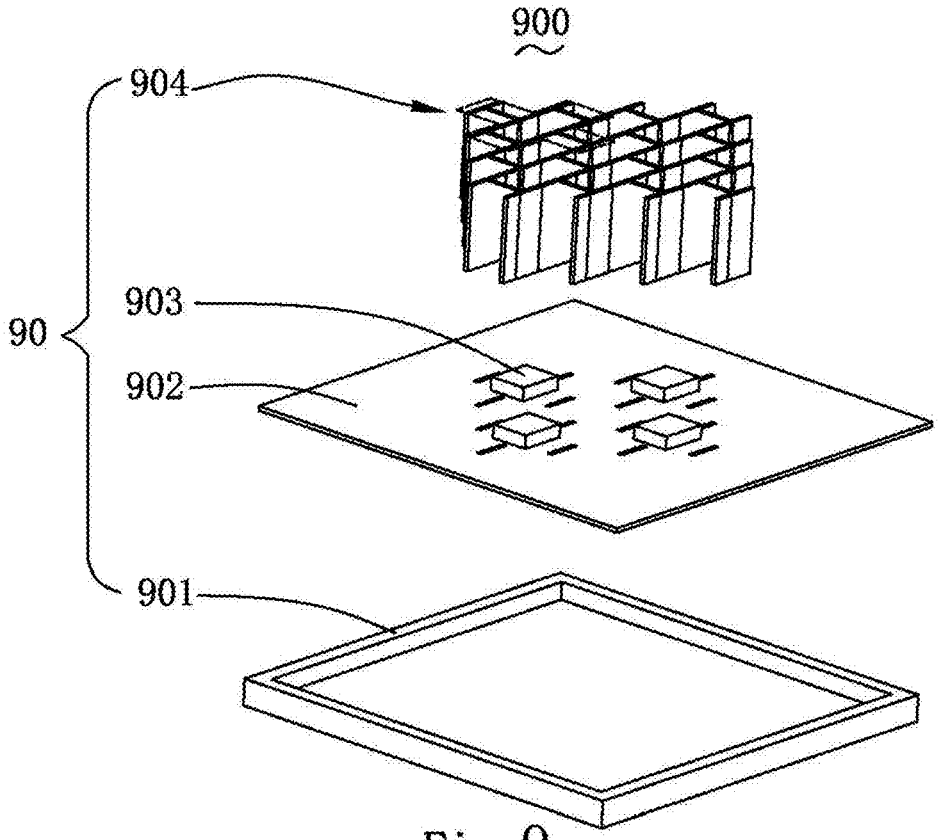
FIG. 9 shows the decomposition of the three-dimensional structure of one of the embodiments of the antenna system of the invention.
Figure 10:
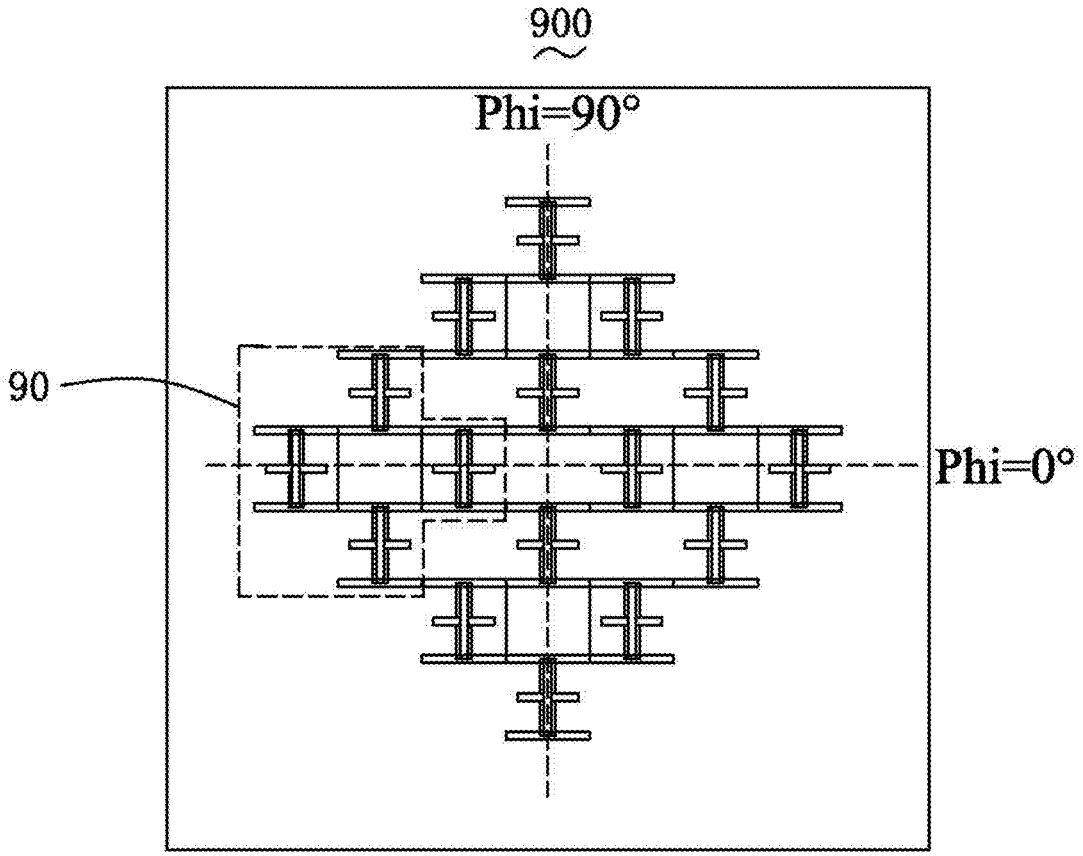
FIG. 10 is the top view of the antenna system of FIG. 9.
Figure 11A:
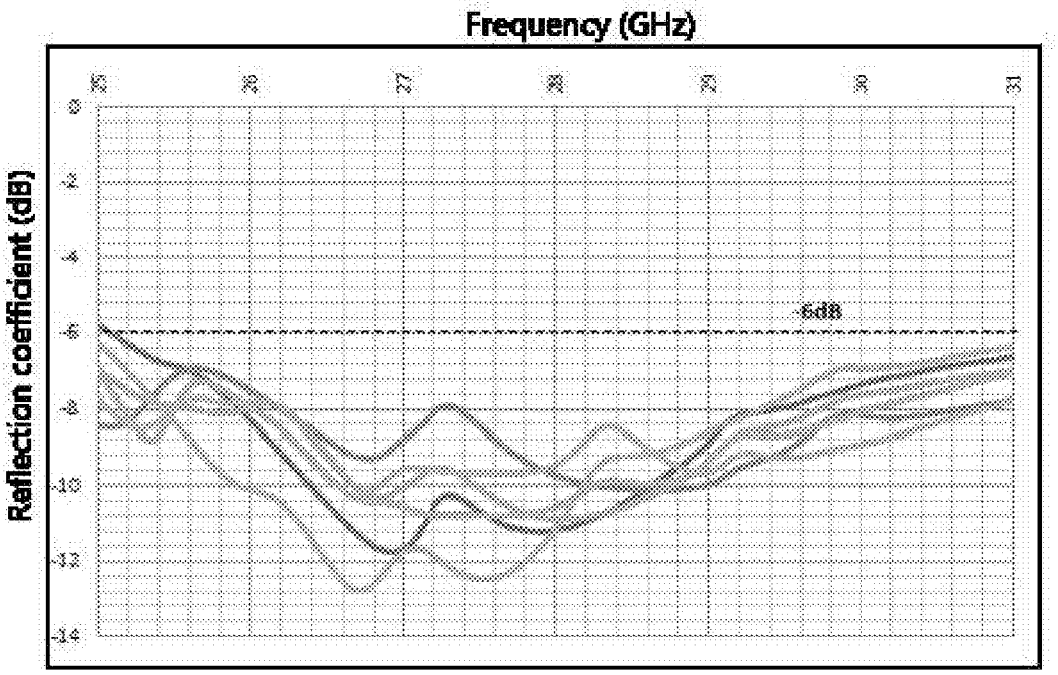
Figure 11B:
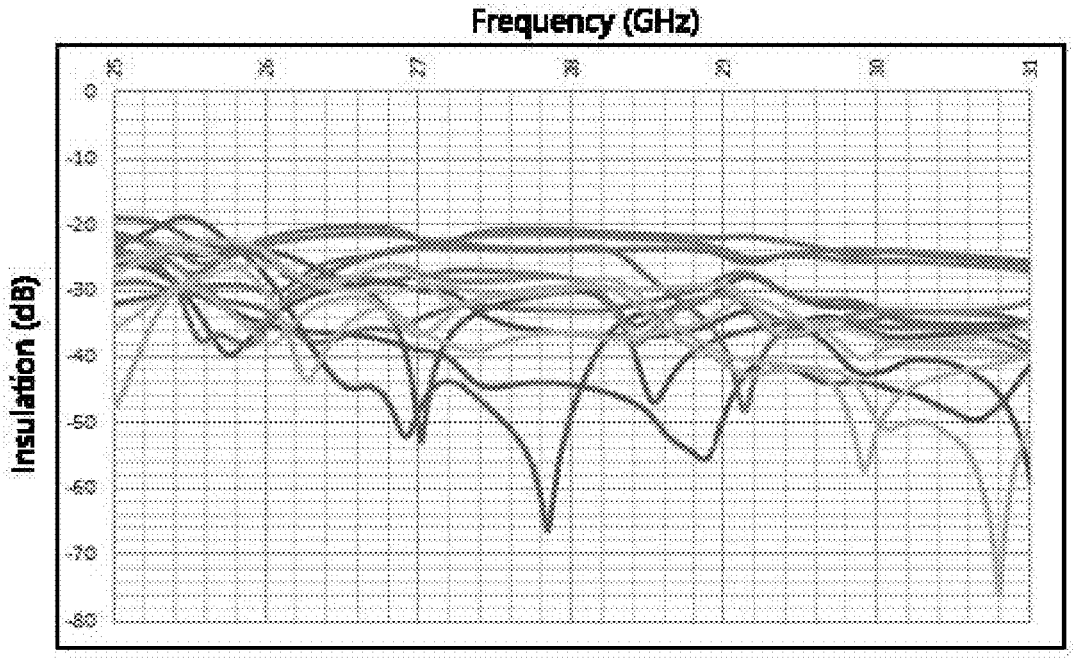

For example, FIGS. 9-10 show the millimeter wave phase control array antenna system structure which is formed by four subarray loudspeaker units 10 and comprises sixteen loudspeakers 41, wherein the loudspeakers 41 stagger to distribute. FIG. 9 shows the decomposition of the three-dimensional structure of one of the embodiments of the antenna system of the invention. FIG. 11*a* and FIG. 11*b* are the top view of the antenna system of FIG. 9.

In the embodiment, the antenna system 900 comprises four subarray loudspeaker units 90 which are in array distribution and mutually and electrically connected to form the millimeter wave phase control array antenna system structure which is formed by 16 loudspeakers. The subarray loudspeaker units 90 are the subarray loudspeaker units 10 in the embodiment above.

More preferably, the metal bases 901 of the four subarray loudspeaker units 90 are in an integrated structure. The circuit boards 902 of the four subarray loudspeaker units 90 are in an integrated structure. The four phase shift units 903 are respectively overlapped on the four circuit boards 902. The four loudspeakers 904 are respectively overlapped on the four circuit boards 902 and electrically connected. The structures of the metal bases 901, the circuit boards 902, the phase shift units 903 and the loudspeaker units 904 are all same as the corresponding structures in the subarray loudspeaker units in the millimeter wave phase control array antenna system formed by the four loudspeakers which stagger to distribute. No more details here.

In the embodiment, please refer to FIG. 11*a*, FIG. 11*b*, FIG. 12*a* and FIG. 12*b*. FIG. 11*a* and FIG. 11*b* are the S-parameter feature curve graph of the antenna system of FIG. 9, FIG. 11*a* is the reflection coefficient curve graph of all loudspeakers in the antenna system. The reflection coefficients of all 16 loudspeakers are lower than −6 dB from 25.2 GHz-30 GHz and the bandwidth is about 5 GHz.

FIG. 11*b* is the curve graph of the isolation degree of one loudspeaker and the other fifteen loudspeakers in the antenna system. The isolation degree is kept to be lower than −18 dB in the frequency range from 25 GHz-31 GHz.

Figure 12A:
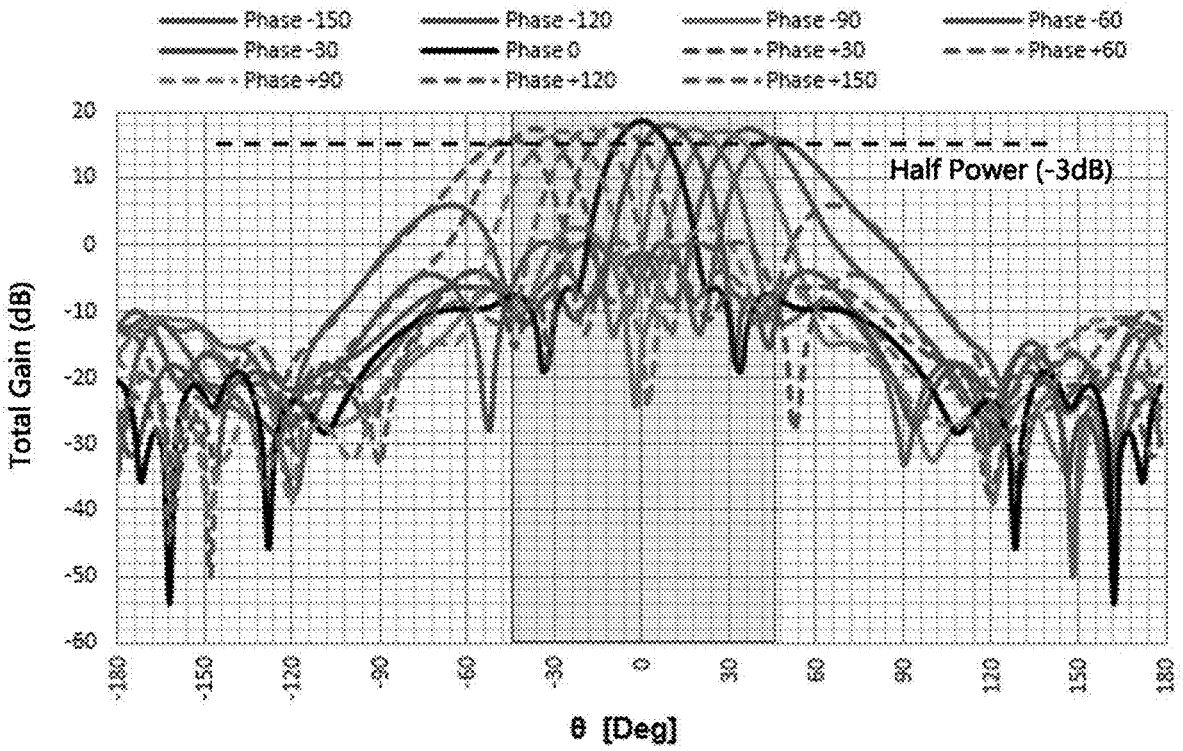
Figure 12B:
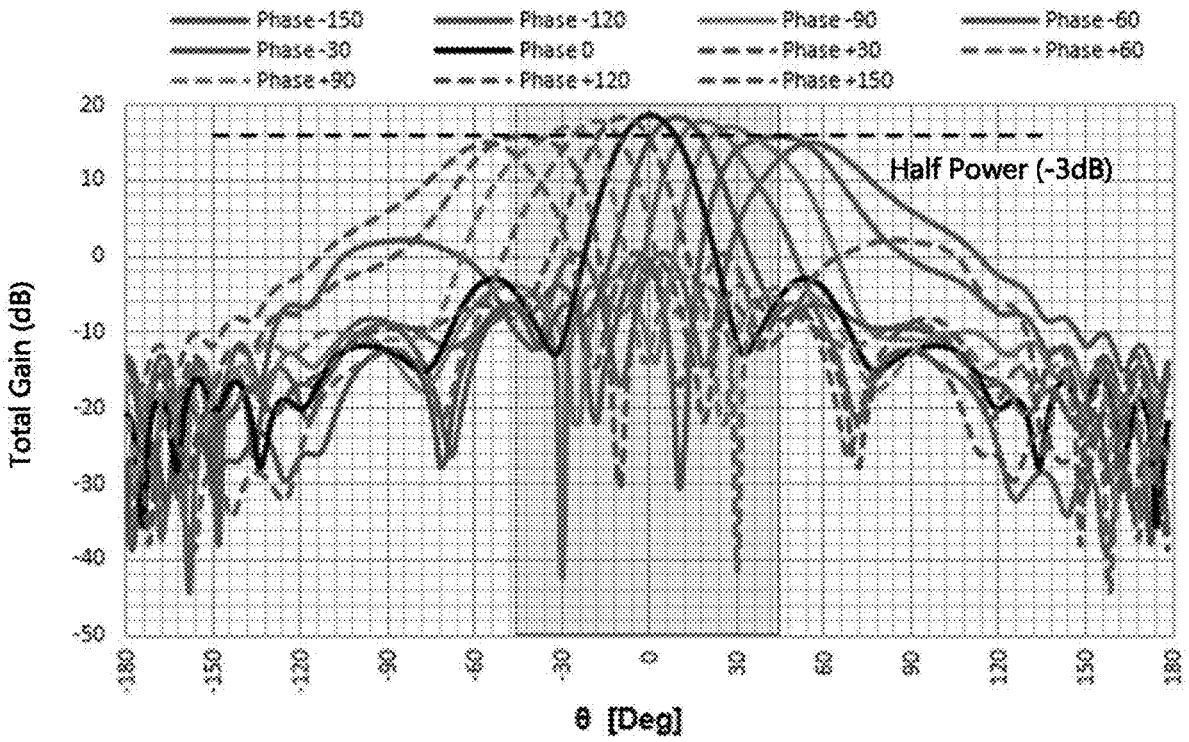

FIG. 12*a* and FIG. 12*b* are the gain curve graph of the antenna system of FIG. 9 at 28 GHz and all loudspeakers have phase differences, wherein, FIG. 12*a* is the gain curve graph in the plane of Phi=0°, and FIG. 12*b* is the gain curve graph in the plane of Phi=90°. Phi=0° plane and Phi=90° plane are planes shown as FIG. 10.

Indicated by FIG. 12*a*, when the phase differences of the corresponding loudspeakers of the antenna system 900 are ±150°, ±120°, ±90°, ±60°, ±30° and 0°, the maximum gain is 18.6 dBi at the frequency of 28 GHz. The antenna system 900 can keep the half power gain which is higher than 15.6 dBi in the range from θ=−45° to θ=45° (total coverage) 90°.

Indicated by FIG. 12*b*, when the phase differences of the corresponding loudspeakers of the antenna system 900 are ±150°, ±120°, ±90°, ±60°, ±30° and 0°, the maximum gain is 18.6 dBi at the frequency of 28 GHz. The antenna system 900 can keep the half power gain which is higher than 15.6 dBi in the range from θ=−45° to θ=45° (total coverage) 90°.

Figure 13:
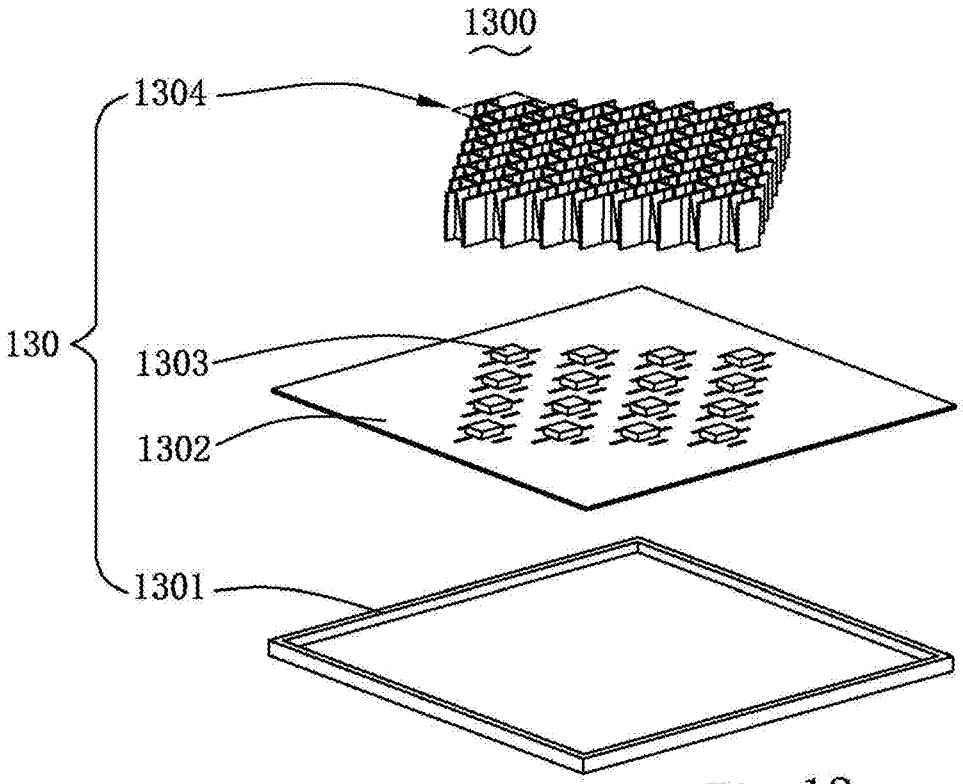
FIG. 13 is the decomposition graph of three-dimensional structure of another embodiment of antenna system of the invention.
Figure 14:
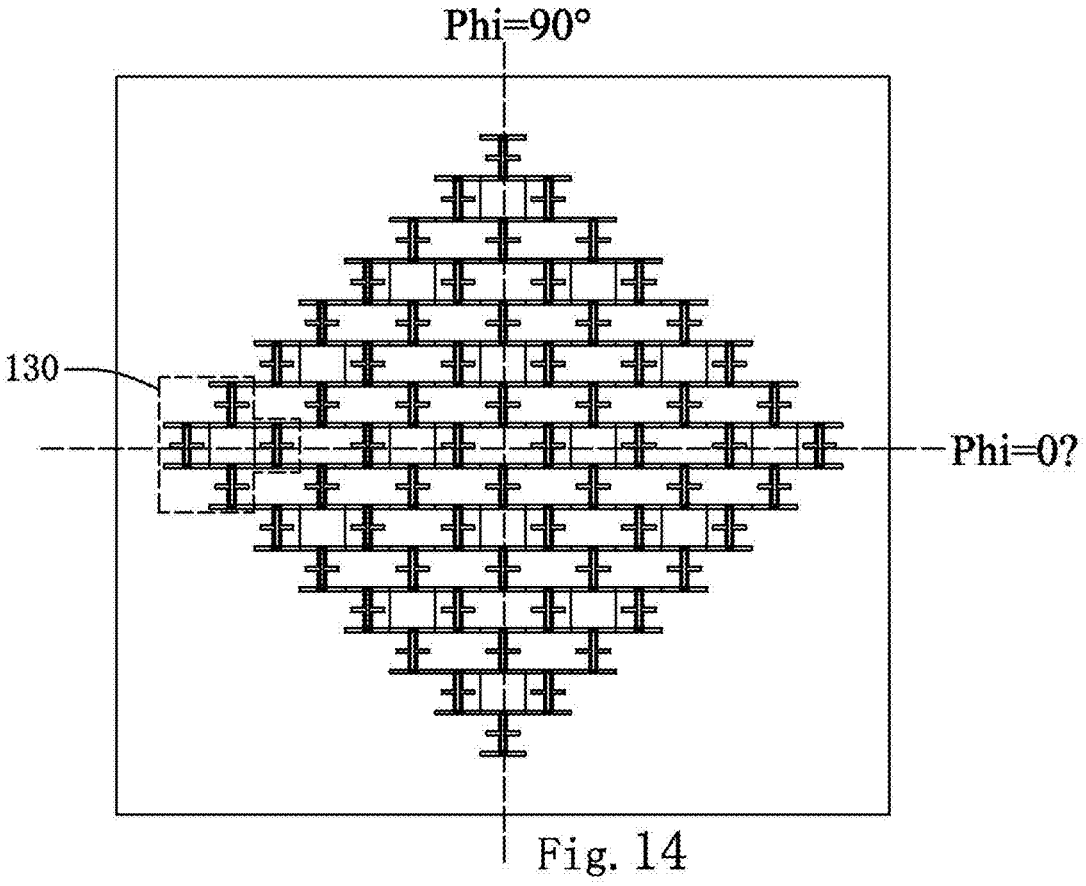
FIG. 14 is the structural top view of the antenna system of FIG. 13.

For the antenna system of the invention, the subarray loudspeaker units 10 can have another embodiment as shown by FIGS. 13-14. Sixteen subarray loudspeaker units 10 form the millimeter wave phase control array antenna system structure comprising of 64 loudspeakers which stagger to distribute, wherein FIG. 13 shows the decomposition of the three-dimensional structure of another embodiment of the antenna system of the invention, and FIG. 14 is the top view of partial structure of the antenna system of FIG. 13.

In the embodiment, the antenna system 1300 comprises sixteen subarray loudspeaker units 130 which are in rectangular distribution and mutually and electrically connected to form the millimeter wave phase control array antenna system structure comprising of 64 loudspeakers which stagger to distribute. The subarray loudspeaker units 130 are the subarray loudspeaker units 10 of the embodiment above.

More preferably, the metal bases 1301 of the sixteen subarray loudspeaker units 130 are in an integrated structure. The circuit boards 1302 of the sixteen subarray loudspeaker units 130 are in an integrated structure. The sixteen phase shift units 1303 are respectively overlapped on the sixteen circuit boards 1302. The sixteen loudspeakers 1304 are respectively overlapped on the sixteen circuit boards 1302 and electrically connected. The structures of the metal bases 1301, the circuit boards 1302, the phase shift units 1303 and the loudspeaker units 1304 are all same as the corresponding structures in the subarray loudspeaker units in the millimeter wave phase control array antenna system above formed by the four loudspeakers which stagger to distribute. No more details here.

Figure 15A:
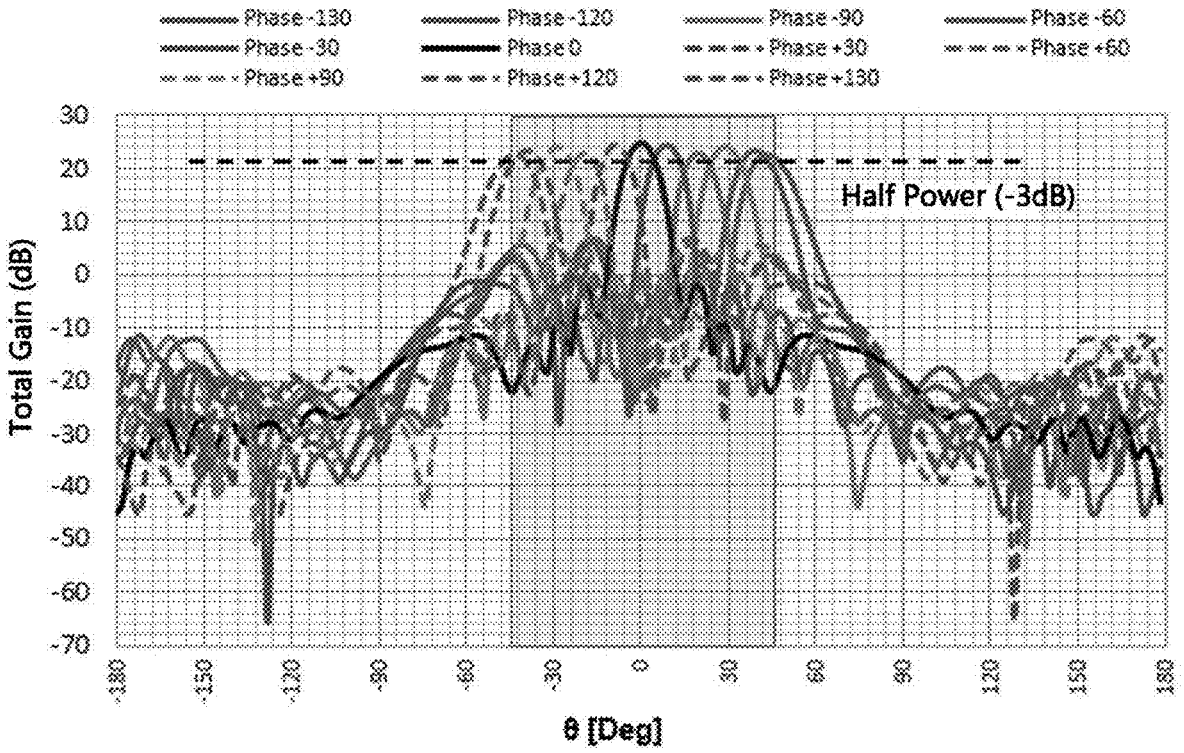
Figure 15B:
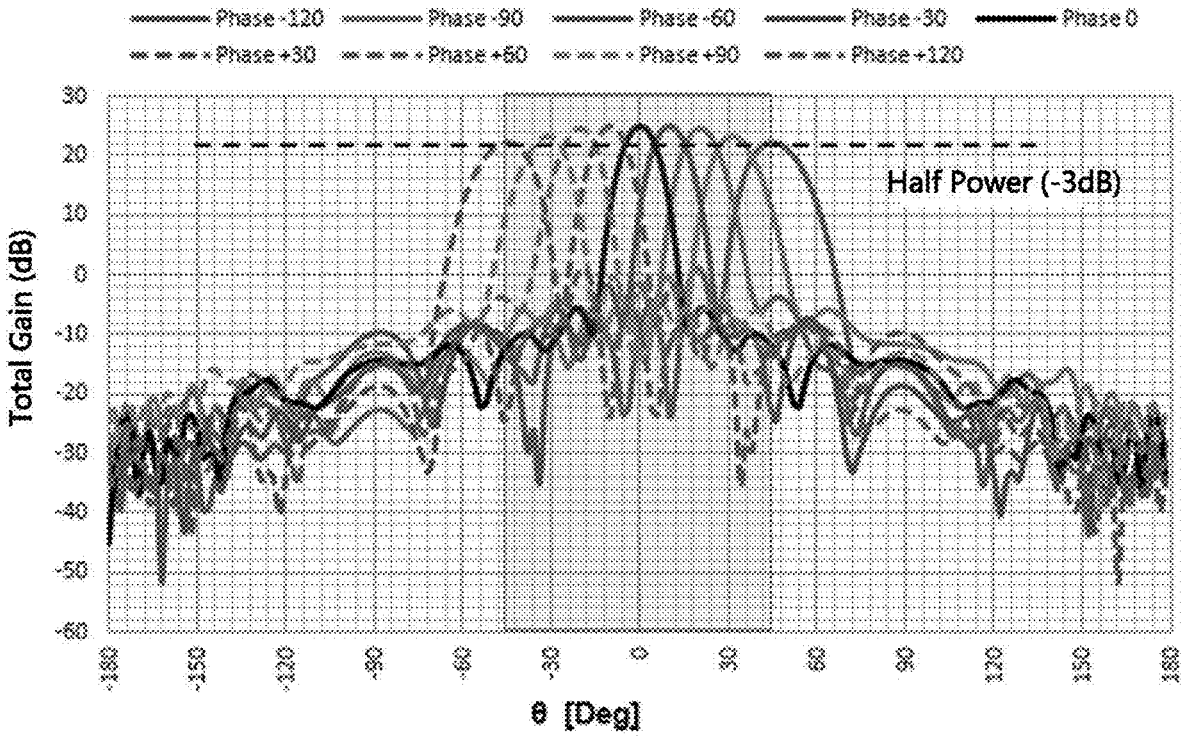

In the embodiment, please refer to FIG. 15*a* and FIG. 15*b*. FIG. 15*a* and FIG. 15*b* are the gain curve graph of the antenna system of FIG. 13 at 28 GHz and all loudspeakers have phase differences, wherein, FIG. 15*a* is the gain curve graph in the plane of Phi=0°, and FIG. 15*b* is the gain curve graph in the plane of Phi=90°. and the plane of Phi=0° and the plane of Phi=90° are respectively the planes which are shown in FIG. 14.

Indicated by FIG. 15*a*, when the phase differences of the corresponding loudspeakers of the antenna system 1300 are ±130°, ±120°, ±90°, ±60°, ±30° and 0°, the maximum gain is 25 dBi at the frequency of 28 GHz. The antenna system 1300 can keep the half power gain which is higher than 22 dBi in the range from θ=−45° to θ=45° (total coverage) 90°.

Indicated by FIG. 15*b*, when the phase differences of the corresponding loudspeakers of the antenna system 1300 are ±120°, ±90°, ±60°, ±30° and 0°, the maximum gain is 25 dBi at the frequency of 28 GHz. The antenna system 1300 can keep the half power gain which is higher than 22 dBi in the range from θ=−45° to θ=45° (total coverage 90°).

It should be noted that in the antenna system of the invention, the number of the loudspeaker units is not limited by 1, 4 or 16. The other number is also possible if the loudspeaker units stagger to distribute. The only difference of the different embodiments mentioned above is the number of the loudspeaker units. The sixteen loudspeakers which stagger to distribute or the sixty four loudspeakers which stagger to distribute are not limited. A phase control array loudspeaker system of a bigger size can also be formed to achieve the required total gain of the antenna system.

The invention also provides a communication terminal, which comprises the antenna system provided by the invention.

Compared with relevant arts, the antenna system and communication terminal of the invention design the antenna system into one or a plurality of subarray loudspeaker units to form high-gain beams, and the beams are scanned in a large space with the change of the phase shift so as to keep the uninterrupted horizon communication between a receiver and a transmitter which use the antenna system. Then the communication terminal which uses the antenna system has strong and stable communication signals, high reliability and wide covering scope of the frequency range.

The above is only an embodiment of the present invention and is not therefore intended to limit the patent scope of the present invention. Any equivalent structure or equivalent process changes made by using the contents of the present specification and FIGS., used directly or indirectly in other related areas of technology, are included in the patent protection scope of the present invention.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. An antenna system comprising subarray loudspeaker units, wherein the subarray loudspeaker units comprises:

a metal base including a top surface, a bottom surface opposite to the top surface, and a carinal cavity formed by depressing from the top surface to the bottom surface;

a circuit board overlapped on and electrically connected to the top surface of the metal base for completely covering the carinal cavity, the circuit board further comprising a circuit board body for forming a system ground and four parallel rectangular slots penetrating the circuit board body for forming a central area and for forming feed ports of the subarray loudspeaker units, the feed ports electrically connected to two ends of the slots along a width direction thereof;

a phase shift unit comprising a phase shift chip overlapped on and electrically connected to the circuit board and located at the central area;

loudspeaker units including four loudspeakers electrically connected to the circuit board and connected with each other for surrounding the phase shift unit; wherein the loudspeakers are millimeter-wave antenna loudspeakers, each of the loudspeaker units inserting into a corresponding slot, and including two sidewalls opposite to each other, two ridges spaced formed on the sidewalls, and a dielectric substrate sandwiched between the two ridges; the two ridges being respectively and vertically fixed on inner sides of the two sidewalls which are vertically overlapped on and electrically connected with the circuit board body and respectively located on the two opposite sides of the slots; and wherein the dielectric substrate is opposite to and in vertical abutment with the slot, a width of the dielectric substrate in abutment with the slot is equal to a width of the slot.

2. The antenna system as described in claim 1, wherein the two side walls of the same loudspeakers are parallel to the slot in which the loudspeakers are inserted and symmetric about the slot; each of the loudspeakers forms an opening at the end parts of the two side walls.

3. The antenna system as described in claim 1, wherein each ridge of each of the loudspeakers comprises an outer wall surface and an inner wall surface, the outer wall surface is connected with the side walls and vertical to the circuit board, the inner wall surface gradually opens from the end close to the circuit board towards the end which is far away from the circuit board so that a cross section area of the end of the ridge, which is close to the circuit board, is larger than a cross section area of the end of the ridge, which is far away from the circuit board.

4. The antenna system as described in claim 3, wherein the ridge comprises a fixed part and an extension part, the fixed part connects with the circuit board body, and the extension part extends from the fixed part to the end of the side wall, the extension part gradually opens from the end which is close to the fixed part towards the end which is far away from the fixed part, so that a cross section area of the end of the extension part, which is close to the fixed part, is larger than the a cross section area of the end, which is far away from the fixed part.

5. The antenna system as described in claim 1, wherein the phase shift unit comprises a metal shielding part completely covering the phase shift chip.

6. The antenna system as described in claim 2, wherein the four loudspeakers stagger to distribute and surround the central area, the four loudspeakers are divided into a first set and a second set, the two side walls of the two loudspeakers in the first set are oppositely arranged, the two openings of the two loudspeakers of the second set are oppositely arranged, the two opposite side walls of the two loudspeakers in the first set are respectively sandwiched between the two opposite side walls of the two loudspeakers of the second set.

7. The antenna system as described in claim 1 comprising a plurality of subarray loudspeaker units which stagger to distribute and are mutually and electrically connected to form a phase control array antenna system.

8. The antenna system as described in claim 1, wherein the metal bases of the plurality of subarray loudspeaker units are in an integrated structure, the circuit boards of the plurality of subarray loudspeaker units are in an integrated structure.

* * * * *